US005718601A

United States Patent [19]

Masters et al.

[11] Patent Number: 5,718,601

[45] Date of Patent: Feb. 17, 1998

[54] ELECTRICAL CONNECTOR ASSEMBLY

[76] Inventors: Greg N. Masters, 1215 W. 20th St., Odessa, Tex. 79763; Sidney E. Keith, 2022 Sunray Dr., Odessa, Tex. 79764

[21] Appl. No.: 576,453

[22] Filed: Dec. 21, 1995

[51] Int. Cl.[6] ..... H01R 4/24

[52] U.S. Cl. ..... 439/441; 439/948; 439/95; 439/731

[58] Field of Search ..... 439/439, 440, 439/441, 948, 607, 610, 620, 88, 95, 96, 857, 701, 731, 686, 687

[56] References Cited

U.S. PATENT DOCUMENTS

| | | | |
|---|---|---|---|
| 2,659,872 | 11/1953 | Gilbert . | |
| 3,182,281 | 5/1965 | Salz, Sr. | 439/441 |
| 3,274,531 | 9/1966 | Bourhenne | 439/441 |
| 3,718,889 | 2/1973 | Bartlett . | |
| 4,120,556 | 10/1978 | Waldron et al. | 439/948 |
| 4,272,148 | 6/1981 | Knack, Jr. . | |
| 4,747,785 | 5/1988 | Roberts et al. | 439/88 |
| 4,761,145 | 8/1988 | Goto et al. . | |
| 4,786,260 | 11/1988 | Spaulding | 439/607 |
| 4,954,940 | 9/1990 | Chandler et al. | 439/687 |
| 4,958,260 | 9/1990 | Kobayashi et al. | 439/731 |
| 5,151,054 | 9/1992 | Briones et al. . | |
| 5,484,306 | 1/1996 | Mawby et al. | 439/441 |

*Primary Examiner*—Neil Abrams
*Assistant Examiner*—Yong Ki Kim
*Attorney, Agent, or Firm*—Stephen R. Greiner

[57] ABSTRACT

An electrical connector assembly for a multiconductor cable. The assembly includes a housing having walls defining an interior space and an aperture for admitting a multiconductor cable to the interior space. Remote from the aperture, the housing has an open end for receiving an electrical connector. The electrical connector has an electrically conductive casing with an integral flange and a terminal block formed of an electrically non-conductive material supported within the casing. The terminal block has a number of passages extending through it. Electrically conductive pins are partially disposed within the passages. Each of the pins includes a terminal end protruding into the housing interior space. Each terminal end includes a tubular sleeve, defining an interior cavity and an integral tab extending into the interior cavity. Each such tab has a free end for pressing against a conductor inserted into the interior cavity and holding such in place. Thus, the inventive assembly permits a technician to rapidly fasten the individual conductors of a multiconductor cable to the terminal block without specialized tools or need for soldering.

14 Claims, 2 Drawing Sheets

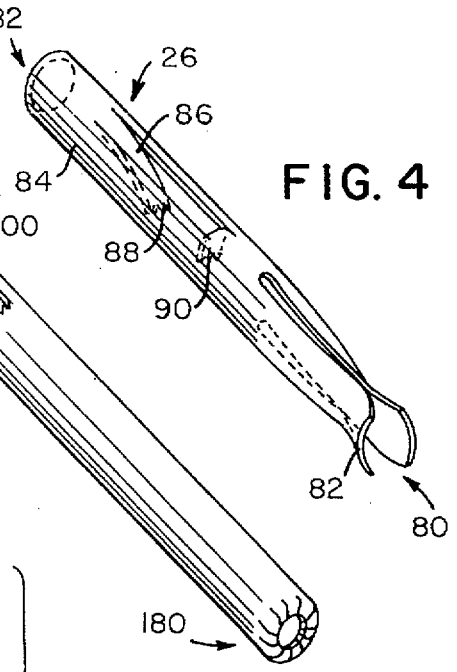
FIG. 4
FIG. 5
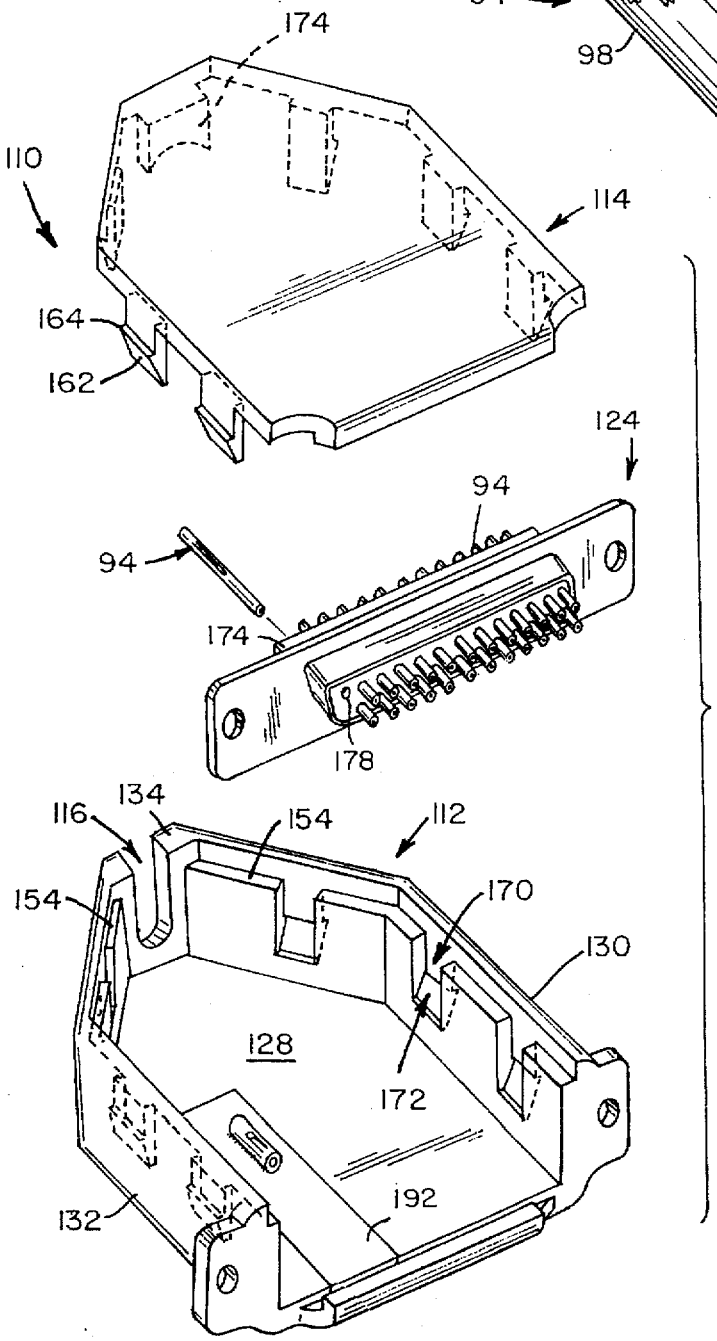
FIG. 6

ELECTRICAL CONNECTOR ASSEMBLY

FIELD OF THE INVENTION

The present invention relates generally to electrical connectors and, in particular, to an electrical connector assembly having solderless means for securing a plurality of electrical conductors thereto.

BACKGROUND OF THE INVENTION

Multiconductor cables are typically utilized to carry electrical signals between a computer and other devices such as a printer or monitor. Special connectors are employed at both ends of these cables to ensure that electrical contact is maintained during their use by securely mating with a cooperating receptacle on the selected device. Unfortunately, the attachment of such a connector to the cable itself has heretofore required a large amount of handwork from a skilled technician, thus adding greatly to the cost of the cable.

For years, the attachment of a connector to a multiconductor cable has required considerable expertise in using several tools and bonding agents. Among these, a soldering iron has had a prominent role in connecting the several conductors of a cable to the electrically conductive pins of a connector. Of course, a technician must also be adept at using pliers, vises and screwdrivers, in addition to solder and flux, to establish a permanent electrical contact.

Recently, crimping tools have been developed which have simplified the process of connecting a connector to a cable. Nonetheless, a technician is still required to insert the individual pins that have been crimped onto an electrical conductor into the terminal block of the connector—a time consuming step. A need, therefore, exists for an electrical connector assembly which may be easily attached to a cable without specialized tools of any kind.

SUMMARY OF THE INVENTION

In light of the problems associated with the prior art electrical connectors, it is a principal object of the invention to provide an electrical connector assembly which may be quickly and securely joined to a multiconductor cable without resort to the laborious steps of soldering or crimping. In the absence of soldering or crimping, it is relatively easy to make needed repairs to the inventive assembly at a later point in time.

It is another object of the invention to provide an electrical connector assembly with a housing of simplified construction. Preferably, the housing includes a removable lid allowing access to the housing interior for connection of electrical conductors to the assembly. Later inspection, repairs and wiring changes are also afforded by the lid. When closed, the lid resists normal impacts and loads to prevent accidental contact with the electrical conductors which could result in electrical shock.

It is a further object of the invention to provide an electrical connector assembly with simplified means for grounding an electrical connector to a multiconductor cable.

It is an object of the invention to provide improved elements and arrangements thereof in an electrical connector assembly for the purposes described which is inexpensive, dependable and fully effective in accomplishing its intended purposes.

Briefly, the electrical connector assembly in accordance with this invention achieves the intended objects by featuring a housing adapted to receive both a multiconductor cable and an electrical connector. The electrical connector has an conductive casing with an integral flange and a non-conductive terminal block within the casing. Electrically conductive pins are partially disposed within passages extending through the terminal block. Each of the pins includes a tubular sleeve, defining an interior cavity, and an integral tab extending into the interior cavity. Each tab has a free end for pressing against a conductor inserted into the interior cavity and holding such in place.

Additional features enhance the utility of the electrically conductive pins. In this regard, the integral tabs are preferably provided with teeth at their distal ends to improve the hold upon a conductor. Also, a second tab may be provided adjacent the first to prevent the insertion of an electrical connector completely through the pin. Finally, the pins may be provided with either a male or female configuration depending on need.

The foregoing and other objects, features and advantages of the present invention will become readily apparent upon further review of the following detailed description of the preferred embodiments and the accompanying drawings.

BRIEF DESCRIPTION OF THE DRAWINGS

The present invention may be more readily described with reference to the accompanying drawings, in which:

FIG. 4 is a greatly enlarged view of a female-type, electrically-conductive pin for use in the electrical connector assembly.

FIG. 5 is a greatly enlarged view of a male-type, electrically-conductive pin for use in the electrical connector assembly.

FIG. 6 is an exploded perspective view of a modified form of the electrical connector assembly.

Similar reference characters denote corresponding features consistently throughout the accompanying drawings.

DETAILED DESCRIPTION OF THE PREFERRED EMBODIMENTS

Figure 1:
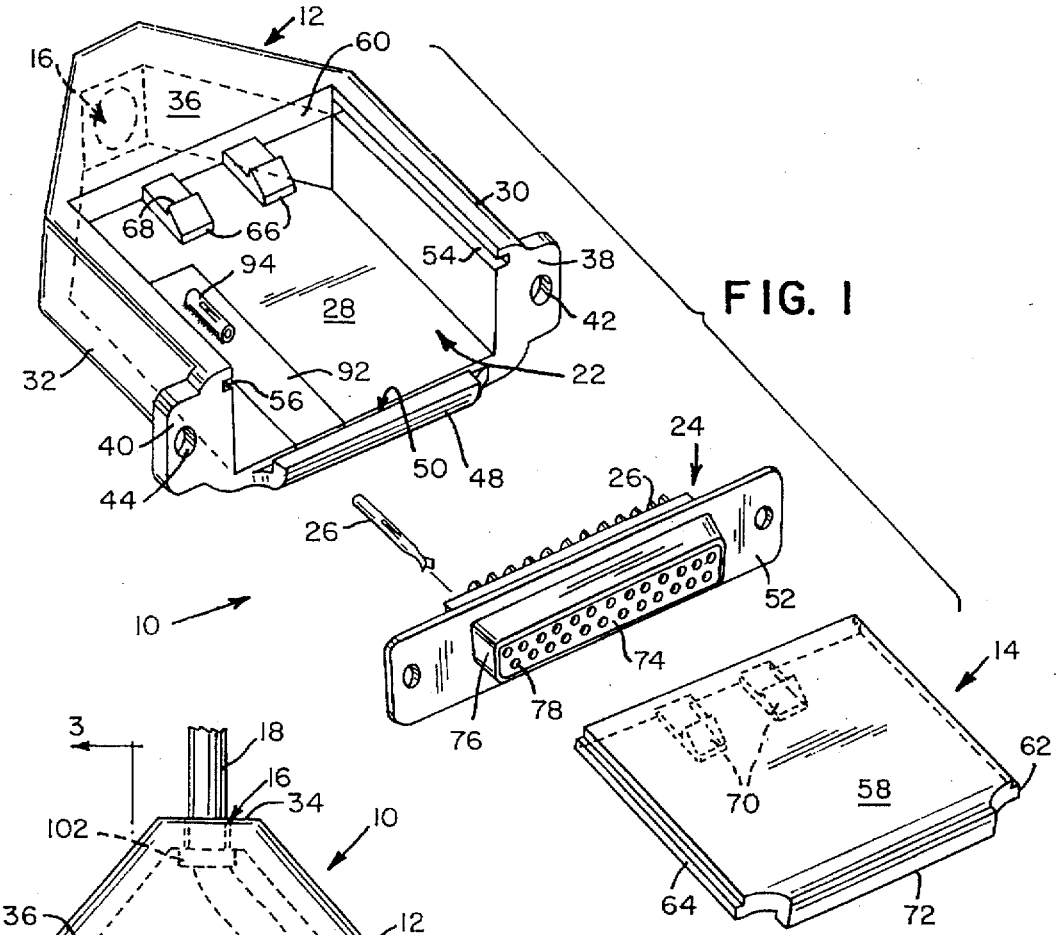
FIG. 1 is an exploded perspective view of an electrical connector assembly in accordance with the present invention.
Figure 2:
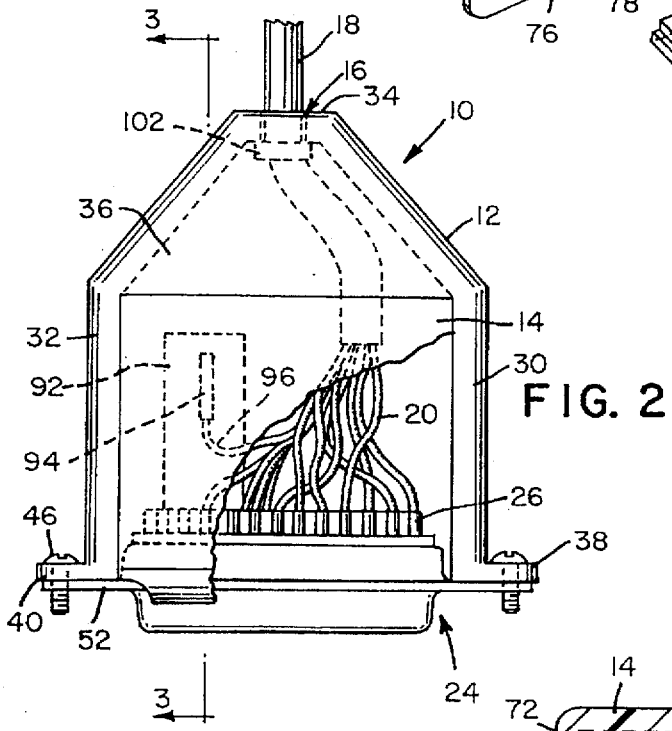
FIG. 2 is a top view of the electrical connector assembly, secured to one end of a multiconductor cable, with portions broken away to show details thereof.
Figure 3:
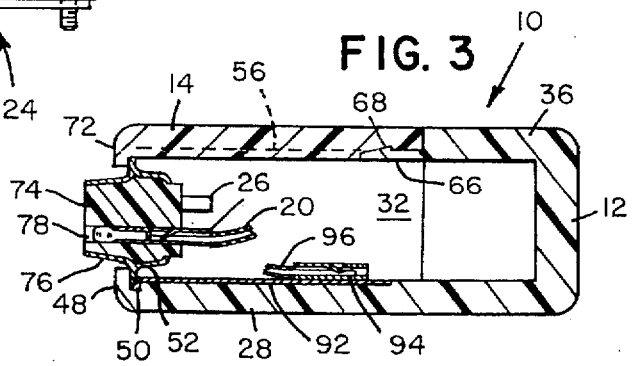
FIG. 3 is cross-sectional view taken along line 3—3 of FIG. 2.

Referring now to FIGS. 1–3, a first embodiment of an electrical connector assembly in accordance with the present invention is illustrated generally at 10. As shown, the connector assembly 10 includes a housing 12 having a slidable lid 14 for selective access to the housing interior. An aperture 16 is provided in one end of the housing 12 for the passage of a cable 18 having a plurality of individually insulated electrical leads or conductors 20. In the end of the housing 12 opposite the aperture 16, a second opening 22 is provided for the receipt of a connector 24. As will be described further hereinbelow, the free ends of the electrical conductors 20 may be easily and securely joined to electrically conductive pins 26 in the connector 26 without resort to soldering or crimping.

The housing 12 is preferably molded as a single unit from a non-conductive plastic material. The housing 12 includes a planar bottom wall 28 having opposed side walls 30 and 32 extending upwardly from it. The side walls 30 and 32 are joined together by the end wall 34 which also extends upwardly from the bottom wall 28. A top wall 36 is secured to the rearward portions of the side walls 30 and 32 as well as to the end wall 34 to form a covered enclosure at one end of the housing 12.

Adjacent the opening 22, a pair of integral flanges 38 and 40 extend outwardly from the opposed side walls 30 and 32 in a plane normal to the bottom wall 28. The flanges 38 and 40 include apertures 42 and 44, respectively, for accommodating screws 46 or other suitable fasteners. By means of the screws 46 or other fasteners, the connector assembly 10 may be secured to a mating connector or electrical device.

An integral retaining lip 48 extends outwardly from the bottom wall 28 between the flanges 38 and 40. The retaining lip 48 has a groove 50 for receiving a flange 52 on the connector 24 to aid in retaining the connector within the opening 22.

The side walls 30 and 32 have longitudinal slots 54 and 56 in their forward portions which act as guides for the sliding movement of the lid 14. Preferably, the slots 54 and 56 extend from the opening 22 at the forward end of the housing 12 to a point adjacent the top wall 36. Further, the slots 54 and 56 are equidistantly spaced from the bottom wall 28 and run parallel thereto. Thus, the slots 54 and 56 form a "track" parallel to the bottom wall 28 for slidably receiving the lid 14.

The lid 14 is preferably made of the same plastic material as the housing 12. As may best be seen with reference to FIG. 1, the lid 14 includes a generally rectangular cover portion 58 adapted to engage the linear abutment surface 60 of the top wall 36 and fully close the open top of the housing 12. The cover portion 58 preferably has a pair of integral ribs 62 and 64 extending outwardly from its opposed sides. The ribs 62 and 64 are axially movable within corresponding slots 54 and 56 in the housing side walls 30 and 32. The ribs 62 and 64 also effectively bear normal compressive loads which may be inadvertently imparted to the cover portion 58 during use of the connector assembly 10.

While in some instances it may be desirable to permanently secure the lid 14 to the housing 12, the preferred construction of the invention permits the lid 14 to be selectively removed for inspection of the housing interior and for rearrangement of the points of attachment of the electrical conductors 20 to the connector 24. In this regard, the top wall 36 is provided with one or more lid retaining arms 66 which extend outwardly from the abutment surface 60 to a distal end located between the slots 54 and 56. The distal end of each of the retaining arms 66 has an upwardly-directed finger 68. These fingers 68 are adapted to mate with correspondingly positioned grooves 70 in the bottom of the cover portion 58 to retain the lid 14. Should it be desired to remove the lid 14, a user need only apply a light downward pressure on the top wall 36 to disengage the fingers 68 from the grooves 70. Then, the lid 14 may be pushed away from the abutment surface 60 to disengage it from the housing 12.

Like the bottom wall 28 of the housing 12, the lid 14 also includes an integral retaining lip 72 to aid in retaining the connector 24. As shown, the lip 72 extends downwardly from the forward end of the cover portion 58 to retain the connector flange 52. Since the connector 24 is preferably retained in a vertical orientation, the retaining lips 72 and 48 are preferably vertically disposed one above the other.

The connector 24 includes a terminal block 74 supported by a tubular metallic casing 76 having the previously-referred-to flange 52. The terminal block 74 is constructed from a non-conductive material and has a plurality of passages 78 passing through it Each of the passages 78 has an electrically conductive pin 26 associated with it.

Referring now to FIGS. 3 and 4, each pin 26 may be seen to have a socket end 80 for positioning within a passage 78 and an opposed terminal end 82 for attachment to an electrical conductor 20. Each pin 26 is preferably formed from a thin strip of resilient metal which has been suitably bent and cut. Preferably the socket end 80 of each pin 26 is provided with a pair of opposed leaf spring contacts 82 for accommodating between them a male electrode (not shown) of another electrical connector or device. These contacts 82 are carried fully within a passage 78 in the terminal block 74 and are secured there by friction between the exterior surface of the pin 26 and the sides of the passage 78.

At the terminal end 82 of the pin 26, the metallic strip is formed into a cylindrical attachment sleeve 84 having an inner diameter sufficient to closely receive the end of an electrical conductor 20 having its protective insulation removed. The attachment sleeve 84 is provided with an inwardly bent tab 86 for locking the conductor 20 within the pin 26 after the uninsulated end of the conductor has been inserted into the sleeve 84 and has been moved past the free end of the tab 86. The free end of the tab 86 is provided with teeth or serrations 88 to further enhance its hold upon the conductor 20.

With continuing reference to FIG. 4, the pin 26 may be seen to be provided with a second inwardly bent tab 90 to stop the conductor 20 from being inadvertently inserted between the leaf spring contacts 82 rendering them inoperative. Preferably, this second tab 90 is positioned in the attachment sleeve 84 between the free end of tab 86 and the leaf springs 82. A strong barrier is provided by bringing the distal or free end of the second tab 90 into contact with the opposing inner wall of the attachment sleeve 84.

A grounding plate 92 is positioned within the upper surfaces of both the bottom wall 28 and retaining lip 48 of the housing 12 to provide a means for grounding the connector 24. The grounding plate 92 comprises a thin, metallic sheet to which a grounding clip or pin 94 is secured for attachment of a grounded conductor 96. The plate 92 may be secured to the housing 12 by any suitable means including, but not limited to, adhesive cement.

The pin 94 is illustrated in FIG. 5 and described more fully hereinbelow. The pin 94 is preferably secured to the plate 94 by soldering or brazing. However, mechanical fasteners or clips (not shown) could be used with equal facility.

The grounded conductor 96 is attached to the pin 94 by inserting its free end into the attachment sleeve 98. The toothed tab 100 extending into the interior of the attachment sleeve 98 effectively prevents the withdrawal of the conductor 96 after its insertion.

Stress relief is provided to the cable 18 by a conventional article-encircling clamp illustrated in broken lines at 102. Although the details thereof are not illustrated in the figures because of their well-known nature, the clamp 102 would preferably comprise a flexible, nylon band having an integral clasp at one of its ends. A locking jaw within the clasp engages the toothed, inner surface of the band and prevents its withdrawal from the clasp.

For use in the present invention, the band 102 is positioned around the cable 18 at a desired location inside the housing 12 and its free end is drawn through the clasp until the cable is snugly engaged. Since the cable 18 is typically sheathed in a soft plastic, it will deform slightly when the band 102 is tightened around it. This deformation allows the toothed, inner surface of the band 102 to firmly bite or grip the cable 18. Since the aperture 16 is sized to prevent the passage of the clamp 102 while encircling the cable 18, longitudinal movement of the cable from the aperture 16 is effectively prevented.

To attach the connector 10 to the cable 18, the cable is first extended through the aperture 16 into the housing 12. The clamp 102 is next secured to the cable 18 and the ends of the electrical conductors 20 and conductor 96 are exposed by removing a portion of their covering insulation. Any shielding (not shown) provided to the cable 18 may be trimmed away at this time so that none is exposed. The conductors 20 and 96 are then inserted into the appropriate pins 26 and 94.

With the connector flange 52 positioned in the groove 50, the lid 14 may be slid into contact with the abutment surface 60 of the top wall 36. By sliding the lid 14 to its closed position, the connector flange 52 is forced into intimate contact with the plate 92 to ground it. Neither solder nor a tool of any kind is required to complete the attachment process.

In FIG. 6 may be seen a modified form of the electrical connector assembly 110 wherein the entire interior space of the housing 112 may be accessed through a fully open top by removal of lid 114. It should be noted that the configuration of the modified assembly 110 includes component parts that correspond generally to the connector assembly 10 described hereinabove and, as such, will not be discussed further. Thus, the following text will be limited to a description of only the modified functional elements of the invention.

The modified housing 112 is integrally molded from a non-conductive plastic. The housing 112 includes a bottom wall 128 having a grounding plate 192 and opposed side walls 130 and 132 extending upwardly from the bottom wall. The side walls 130 and 132 are joined together by an end wall 134 having an upwardly-open slot 116 sized to closely accommodate a cable. The upper surfaces of the side walls 130 and 132 and end wall 134 are provided with a recessed ledge 154 to support the lid 114 at a fixed height above the bottom wall 128.

The lid 114 is provided with a plurality of integral retaining arms 162 for releasably securing it to the housing 112. As shown, the retaining arms 162 extend downwardly from the bottom surface of the lid 114 and are spaced along its side edges. The distal end of each retaining arm 162 is provided with an outwardly directed finger 164 adapted to engage one of the side walls 130 or 132 of the housing 112.

Preferably, the side walls 130 and 132 include a plurality of vertically oriented channels 170 to receive the retaining arms 162. At the bottom of each of the channels 170, a recess 172 is provided for mating with the fingers 164. To secure the lid 114 to the housing 112, a user need only locate the retaining arms 162 in the respective tops of the corresponding channels 170 and press downwardly. On the other hand, should it be desired to remove the attached lid 114, a user need only apply a relatively-light and outwardly-directed force to the upper surface of either of the side walls 130 or 132 to resiliently deform such and disengage the fingers 164 from the recesses 172. Once done, the lid 114 may be easily lifted from the housing 112.

A cable engaging member 174 is provided to the lid 114 to offer stress relief to a cable (not shown) fitted within the slot 116. Acting in vise-like fashion, the member 174 truncates the opening presented by the slot 116 when the lid 114 is pressed into locked engagement with the housing 112. A cable of suitable size, then will be captured between the member 174 and the portion of end wall 134 forming the periphery of the slot 116.

With continuing reference to FIG. 6, each of the passages 178 through the conductor 124 may be seen to be provided with an electrically conductive pin 94 which is held in place by friction. Like the pin 26, pin 94 includes an inwardly bent and toothed tab 100 to retain an electrical conductor. The pin 94 is provided with a relatively longer length, however, so that it will protrude outwardly from both sides of terminal block 174. The socket end 180 of the pin 94 comprises a male-type, unitary contact to permit mated connection with a female-type electrical connector.

While both embodiments of the invention have been described with a high degree of particularity, it will be appreciated by those skilled in the art that numerous modifications may be made thereto. For example, the connectors 24 and 124 may be used interchangeably in either of the housing and lid structures of FIGS. 1 and 6. Also, means other than friction may be employed to retain the pins 26 and 94, respectively, in terminal blocks 74 and 174. Thus, the pins could be adhesively attached or, in the alternative, may be provided with outwardly-directed projections adapted to grip the side walls of their retaining passages. Therefore, it is to be understood that the present invention is not limited to the embodiments described above, but encompasses any and all embodiments within the scope of the following claims.

I claim:

1. An electrical connector assembly for a multiconductor cable, said electrical connector assembly comprising:

a housing defining an interior space and having an open end, said housing also having an aperture remote from its open end for admitting a multiconductor cable into said interior space;

an electrical connector in said open end of said housing, said electrical connector having an electrically conductive casing with an integral flange and a terminal block formed of an electrically non-conductive material within said casing, said terminal block having a plurality of passages extending from one side to the other thereof; and, a plurality of electrically conductive pins, each of said pins including a socket end positioned within one of said passages, each of said pins also including a terminal end connected to said socket end and protruding into said interior space of said housing, each said terminal end including a tubular sleeve, defining an interior cavity, and a first integral tab extending into said interior cavity from said tubular sleeve, each said first integral tab having a free end adapted to press against a conductor from the cable upon insertion of the conduct into said interior cavity and to hold such in place.

2. The electrical connector assembly according to claim 1 wherein each said integral tab has a plurality of teeth at its distal end to securely engage a conductor.

3. The electrical connector assembly according to claim 1 wherein each of said pins includes a second integral tab extending into said interior cavity from said tubular sleeve, said second tab being positioned adjacent said socket end so as to provide a stop for the end of an electrical conductor.

4. The electrical connector assembly according to claim 1 wherein said socket end of each of said pins comprises a pair of opposed leaf spring contacts.

5. The electrical connector assembly according to claim 1 wherein said socket end of each of said pins comprises a unitary contact extending through its associated passage and outwardly from said terminal block so as to permit connection to a female-type electrical connector.

6. The electrical connector assembly according to claim 1 wherein said housing further includes an electrically conductive grounding plate secured within its interior space and positioned to contact said flange of said electrical connector, said plate having a grounding clip secured in electrical contact thereto, said grounding clip including a second tubular sleeve, defining a second interior cavity, and a third integral tab extending into said second interior cavity from said second tubular sleeve, said third integral tab having a free end adapted to press against a grounded conductor from the cable upon insertion of the grounded conductor into said second interior cavity and hold such in place.

7. The electrical connector assembly according to claim 1 wherein said housing further includes a slidable lid for selective access to said interior space, and said lid includes an integral retaining lip for engaging said integral flange.

8. The electrical connector assembly according to claim 7 wherein said housing further includes at least one lid retaining arm having an outwardly-directed finger at its distal end, said finger being adapted to mate with a correspondingly positioned groove in said slidable lid so as to secure said slidable lid in place.

9. The electrical connector assembly according to claim 1 wherein said housing further comprises a bottom wall having opposing side walls extending normally upward therefrom and a selectively removable lid bridging said side walls, said side walls including a plurality of vertically oriented channels spaced along their respective lengths, each of said channels having a relatively deep recess at its bottom, said lid having a plurality of downwardly extending retaining arms for positioning within said channels, each of said arms having an outwardly extending finger at its bottom for positioning within one said recess for securing said lid in place, and said lid having an integral retaining lip for engaging said integral flange.

10. An electrical connector for a multiconductor cable, said electrical connector comprising:

an electrically conductive casing with an integral flange and an electrically non-conductive block within said casing, said block having a plurality of passages extending from one side to the other thereof; and, a plurality of electrically conductive pins, each of said pins including a socket end positioned within one of said passages, each of said pins also including a terminal end joined to said socket end and protruding from said block, each said terminal end including a tubular sleeve, defining an interior cavity, and a first integral tab extending into said interior cavity from said tubular sleeve, each said first integral tab having a free end adapted to press against a conductor from the cable upon insertion of the conductor into said interior cavity and to hold such in place.

11. The electrical connector according to claim 10 wherein each said integral tab has a plurality of teeth at its distal end to securely engage a conductor.

12. The electrical connector according to claim 10 wherein each of said pins includes a second integral tab extending into said interior cavity from said tubular sleeve, said second tab being positioned adjacent said socket end to provide a stop for the end of an electrical conductor.

13. The electrical connector according to claim 10 wherein said socket end of each of said pins comprises a pair of opposed leaf spring contacts.

14. An electrical connector according to claim 10 wherein said socket end of each of said pins comprises a unitary contact extending through its associated passage and outwardly from said block so as to permit connection to a female-type electrical connector.

* * * * *